US007055297B1

(12) United States Patent
Evangelisti et al.

(10) Patent No.: US 7,055,297 B1
(45) Date of Patent: Jun. 6, 2006

(54) VACUUM PACKAGING MACHINE

(75) Inventors: Riccardo Evangelisti, Milan (IT); Joel Caillier, Cham (CH)

(73) Assignee: Cryovac, Inc., Duncan, SC (US)

( * ) Notice: Subject to any disclaimer, the term of this patent is extended or adjusted under 35 U.S.C. 154(b) by 0 days.

(21) Appl. No.: 09/830,245

(22) PCT Filed: Oct. 27, 1999

(86) PCT No.: PCT/EP99/08131

§ 371 (c)(1),
(2), (4) Date: Jul. 9, 2001

(87) PCT Pub. No.: WO00/27706

PCT Pub. Date: May 18, 2000

(51) Int. Cl.
*B65B 31/02* (2006.01)

(52) U.S. Cl. ..... 53/510; 53/512

(58) Field of Classification Search ..... 53/510, 53/512, 432, 434, 373.7, 375.9; 198/361, 198/890, 369.1, 369.3, 369.6, 370.01, 435, 198/578, 586, 589, 606, 607, 782, 831
See application file for complete search history.

(56) References Cited

U.S. PATENT DOCUMENTS

| | | | | |
|---|---|---|---|---|
| 3,580,141 | A * | 5/1971 | Richter | 198/435 |
| 3,816,969 | A | 6/1974 | Zimmerman et al. | |
| 3,850,755 | A | 11/1974 | Welty | |
| 3,958,391 | A | 5/1976 | Kujubu | |
| 3,990,214 | A * | 11/1976 | Bell et al. | 53/512 |
| 4,471,599 | A * | 9/1984 | Mugnai | 53/434 |
| 4,550,548 | A * | 11/1985 | Owensby et al. | 53/434 |
| 4,791,775 | A * | 12/1988 | Raque et al. | 53/510 |
| 4,813,526 | A * | 3/1989 | Belanger | 198/589 |
| 4,869,050 | A * | 9/1989 | Furukawa | 53/432 |
| 5,044,142 | A * | 9/1991 | Gianelli | 53/434 |
| 5,088,268 | A * | 2/1992 | Gunter | 53/510 |
| 5,155,969 | A * | 10/1992 | Kuethe | 53/510 |
| 5,692,593 | A * | 12/1997 | Ueno et al. | 198/435 |
| 6,105,751 | A * | 8/2000 | Jentjens et al. | 198/435 |
| 6,227,377 | B1 * | 5/2001 | Bonnet | 198/435 |

FOREIGN PATENT DOCUMENTS

| | | |
|---|---|---|
| CA | 2006765 | 12/1989 |
| EP | 0 476 290 A1 | 8/1991 |
| EP | 0 836 996 A1 | 10/1996 |
| WO | WO 96/11844 | 4/1996 |
| WO | WO 98/12111 | 3/1998 |

* cited by examiner

*Primary Examiner*—John Sipos
(74) *Attorney, Agent, or Firm*—MArk B. Quatt

(57) ABSTRACT

A vacuum packaging machine for performing a vacuum sealing operation on product packages, comprises a vertical stack of vacuum chambers 4 which each manage to receive at least one unsealed product package 2 and are operable to perform an independent vacuum sealing operation on the least one product package 2. A conveyor arrangement 8, 9 is operable to load and unload a selected vacuum chamber 4 with the at least one product package, and the machine is arranged to operate the respective vacuum chambers 4 to perform the vacuum sealing operation while the conveyor arrangement is operated to load and unload another vacuum chamber 4. The conveyor arrangement loads and unloads the vacuum chambers in sequence, and the vacuum chambers are synchronously operated to perform the vacuum sealing operation to allow the conveyor arrangement to operate continuously. The conveyor arrangement comprises at least one in-feed conveyor 8 and at least one out-feed conveyor 9 which are independently movable to select the vacuum chamber to be loaded and unloaded. There may be a plurality of in-feed conveyors 8 and a plurality of out-feed conveyors 9. The vacuum chambers each have a sealing bar arranged along one side for sealing the product packages 2.

19 Claims, 5 Drawing Sheets

VACUUM PACKAGING MACHINE

The present application is a 35 USC §371 application of PCT/EP99/08131 filed Oct. 27, 1999, which claims the benefit of priority European Patent Application Serial No. 93308823.8 filed Oct. 28, 1998.

The present invention relates to a vacuum packaging machine for performing a vacuum sealing operation on product packages.

Vacuum packaging machines of a known type comprise a vacuum chamber arranged to receive at least one unsealed product package and operable to perform a vacuum sealing operation on the at least one product package. Typically the product packages are products such as food stuff arranged in a bag formed by a heat-shrinkable film. After loading and closing the vacuum chamber, the vacuum sealing operation normally comprises vacuumisation, sealing the mouth of the vacuumised bags, and reintroducing air into the chamber. Then the chamber is opened and the vacuum chamber is unloaded. The product packages may then be conveyed to a heat-shrinking unit, typically a hot water tunnel or a dip tank.

The vacuumisation step typically takes at least 20–30 seconds which is mostly wasted time in the overall packaging process. During this time, the only step which can be taken is to prepare the next product packages for loading into the vacuum chamber, for example by conveying them onto an in-feed conveyor. Accordingly, the vacuum packing machine causes a bottle-neck in the overall packaging process.

According to the present invention, there is provided a vacuum packaging machine for performing a vacuum sealing operation on product packages, comprising a vertical stack of vacuum chambers each arranged to receive at least one unsealed product package and operable to perform an independent vacuum sealing operation on the at least one product package.

The provision of more than one vacuum chamber in the vacuum packaging machine allows respective vacuum chambers to perform a vacuum sealing operation while another vacuum chamber is being loaded and/or unloaded. Therefore, the machine may minimise the wasted time in the vacuum packaging process. Consequently, the present invention can increase through-put and increase productivity of a packaging line including the machine. Furthermore, by arranging the vacuum chambers in a vertical stack, this increase in productivity may be achieved without significantly increasing the floor area of the vacuum packaging machine. The extra vacuum chambers only increase the height of the machine. This is a significant advantage in manufacturing plants where increasing the footprint of the vacuum packaging machine would create real problems but where there is normally space to increase the height of the machine.

Preferably, the vacuum packaging machine further comprises a conveyor arrangement operable to load and unload a selective vacuum chamber with the at least one product package, the machine being operable to operate the respective vacuum chambers to perform the vacuum sealing operation while the conveyor arrangement is operated to load and unload another vacuum chamber.

The conveyor arrangement can automatically load and unload selected vacuum chambers. Operation of one or more of the vacuum chambers while the conveyor arrangement is loading and unloading another vacuum chamber reduces the amount of time wasted, thereby increasing through-put and increasing productivity of a packaging line including the machine.

Preferably, the machine is operable to operate the conveyor arrangement to load and unload the vacuum chambers in a cyclical sequence and synchronously to operate the respective vacuum chambers to perform the vacuum sealing operation on the at least one product packages after loading.

Such a cyclical operation allows the machine to be utilised in an automatic continuous packaging line. It is desirable that the number of vacuum chambers is sufficient relative to the duration of the vacuum sealing operation to allow the conveyor arrangement to operate continuously because this minimises the amount of wasted time. Time wastage can be reduced further by designing the conveyor arrangement to load and unload the vacuum chambers more rapidly. The described embodiments include particularly suitable conveyor arrangements as follows.

Preferably, the conveyor arrangement includes at least one in-feed conveyor operable to load a selected vacuum chamber with the at least one product package.

Preferably, the conveyor arrangement includes at least one out-feed conveyor operable to unload a selected vacuum chamber with the at least one product package, although as an alternative the in-feed conveyor may be operable in reverse to unload a selected vacuum chamber.

Provision of separate in-feed and out-feed conveyors allows the loading and unloading to occur simultaneously, preferably with the in-feed and out-feed conveyors being linked by an internal conveyor in each vacuum chamber.

Preferably, the at least one in-feed conveyor and/or the at least one out-feed conveyor are vertically movable to select the vacuum chamber to be loaded. Additionally or alternatively, the plurality of vacuum chambers are movable together relative to the conveyor arrangement to select the vacuum chamber to be loaded and unloaded.

The conveyor arrangement may include a plurality of in-feed conveyors and/or out-feed conveyors which are movable together. In this case, the vacuum chambers are preferably have a regular spacing and the in-feed conveyors and/or out-feed conveyors have a relative spacing equal to the spacing between the vacuum chambers. This allows more than one vacuum chamber to be loaded and/or unloaded simultaneously.

Desirably, the vacuum chambers each have a sealing bar arranged along a side of the respective vacuum chamber for sealing the at least one product packages, preferably extending along the internal conveyor. This prevents the sealing bar from hindering loading and unloading improves the automatic operation of the machine because the product packages always have the same orientation.

Advantageously, the vacuum chambers and/or the in-feed conveyors and/or the out-feed conveyors have a modular construction. This allows the modular parts to be added and removed in order to assemble the machine with a variable number of the parts in order to provide a productivity and cost appropriate to the particular packaging line in which the machine is used. Thus, this modular construction increases the flexibility of the machine and allows it to be used in different packaging lines. This flexibility is particularly advantageous with the vacuum chambers being arranged in a vertical stack because the productivity of the machine may be altered whilst covering the same floor space within the manufacturing plant because only the height of the machine is altered.

Advantageously, each vacuum chamber comprises at least two parts which are relatively vertically movable to open and close the vacuum chamber. This construction for the vacuum chambers is advantageous because it allows for a simple machine design, lower manufacturing costs and simple servicing and maintenance operations as compared to a vacuum chambers which are open and closed by the provision of doors.

In order that the present invention may be better understood, the following description of preferred embodiments is given by way of non-limitative example with reference to the accompanying drawings in which.

Figure 1:
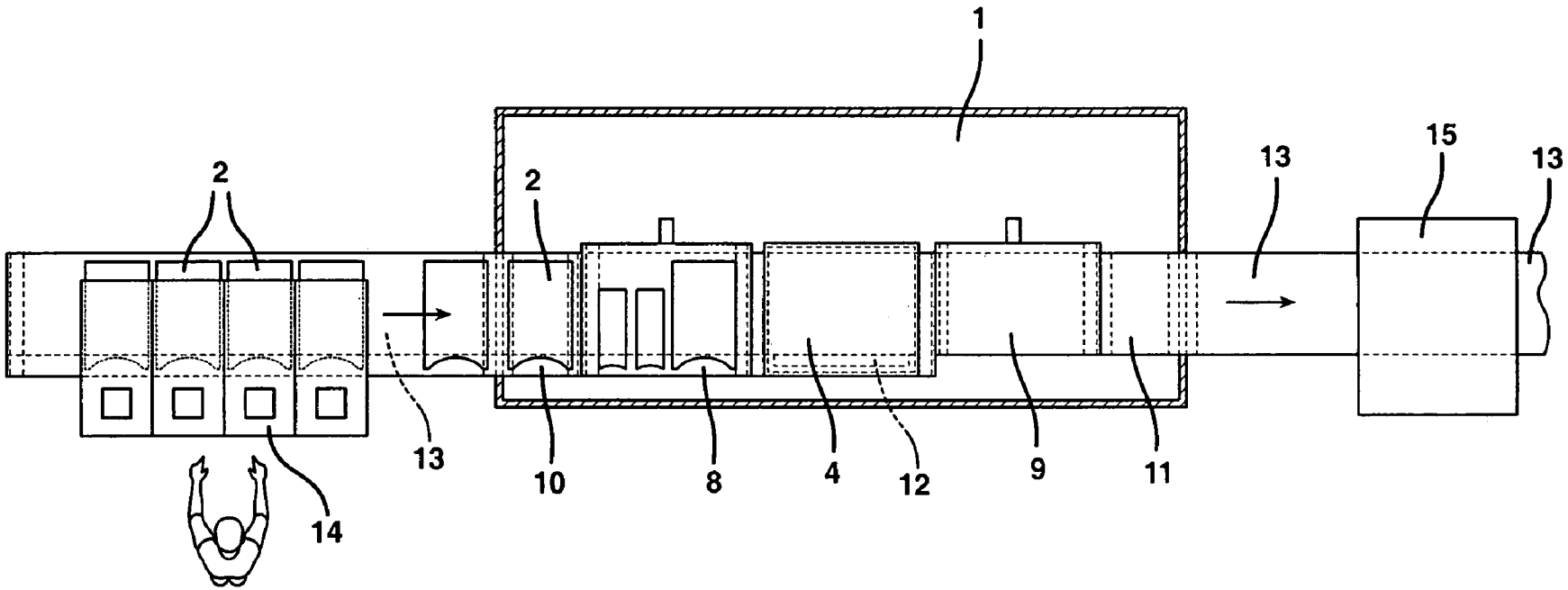
FIG. 1 is a top plan view of a packaging line including a vacuum packaging machine which is a first embodiment of the present invention.

FIG. 1 is a top plan view of a vacuum packaging machine 1 which is an embodiment of the present invention arranged in a packaging line 13 constituted by a series of conveyors. At a bagging section 14, products are bagged in heat-shrinkable film bags, or alternatively in small pouches made from thin films, and arranged on line 13 as product packages 2. A vacuum packaging machine 1 performs a vacuum sealing operation on the product packages 2 which are then output back onto the packaging lines 13 which conveys them through a shrink tunnel 15 to perform a heat-shrinking operation. The product packages 2 move continuously through the shrink tunnel 15 which is advantageous over heat-shrinking of products in batches where it is difficult to obtain uniform shrinking of the packaging around each product as a result of contact or proximity between the various product packages 2.

FIGS. 2 to 5 are sectional side views of various arrangements for the vacuum packaging machine 1. FIGS. 2 to 5 are schematic for ease of understanding of the overall arrangement and operation. Details of the structure of the vacuum packaging machine are given subsequently.

The vacuum packaging machine 1 has a body 3 supporting a plurality of vertically stacked vacuum chambers 4. As can be seen in FIG. 1, since the vacuum chambers 4 are stacked vertically, they only occupy the same floor space as a single vacuum chamber. Except as described below, each vacuum chamber 4 is in itself of conventional construction and performs a vacuum sealing operation in a conventional manner.

Each vacuum chamber 4 has a modular construction allowing vacuum chambers to be added or removed from the vacuum packaging machine 1. For example, in the arrangement illustrated in FIG. 2, there are two vacuum chambers 4*a*, 4*b*. In the arrangements illustrated in FIGS. 3 and 4, an additional vacuum chamber 4*c* has been added so that there are three vacuum chambers 4*a*, 4*b*, 4*c*. In the arrangement illustrated in FIG. 5, there are four vacuum chambers, 4*a*, 4*b*, 4*c*, 4*d*.

The vacuum chambers 4*a*, 4*b*, 4*c*, and 4*d* each have a respective internal chamber conveyor 5*a*, 5*b*, 5*c*, and 5*d* to convey product packages 2 therethrough, and a respective sealing bar 12 arranged long one side of each chamber extending along the corresponding chamber conveyor 5*a*, 5*b*, 5*c*, and 5*d*. Provision of a sealing bar 12 on the side of each chamber conveyor 5*a*, 5*b*, 5*c*, and 5*d* facilitates automatic feeding and loading is made easier by the bags being orientated in the same direction.

Each chamber has a respective entrance 6*a*, 6*b*, 6*c*, and 6*d* and exit 7*a*, 7*b*, 7*c*, and 7*d*. Opening and closing of the vacuum chambers is described in more detail subsequently.

At least one in-feed conveyor 8 and at least one out-feed conveyor 9 are provided on opposite sides of the vacuum chambers 4 facing entrances 6 and exits 7. The in-feed and out-feed conveyors 8, 9 are independently vertically moveable, for example between a lower-position shown in bold outline in FIG. 2 for loading and unloading the lower vacuum chamber 4*a* and a higher position shown in dotted outline in FIG. 2 for loading and unloading the upper vacuum chamber 4*b*.

The in-feed conveyors 8 and the out-feed conveyors 9 have a modular construction allowing additional conveyors to be added or removed. In the arrangements illustrated in FIGS. 2 and 3 only a single in-feed conveyor 8 and an out-feed conveyor 9 are used. In the arrangements illustrated in FIGS. 4 and 5, conveyors have been added so that there are a pair of in-feed conveyors 8*a*, 8*b* and a pair of out-feed conveyors 9*a*, 9*b*. Where plural in-feed or out-feed conveyors 8, 9 are provided, these are arranged in a vertical stack with the in-feed conveyors 8 being moveable together as a unit and the out-feed conveyors being moveable together as a unit.

A fixed input conveyor 10 is provided to receive unsealed product packages 2 into the machine 1 from station 14 along packaging line 13 and supply them to the in-feed conveyor 8. Another fixed output conveyor 11 receives sealed packages from the out-feed conveyor 9 and outputs them along line 13.

Figure 2:
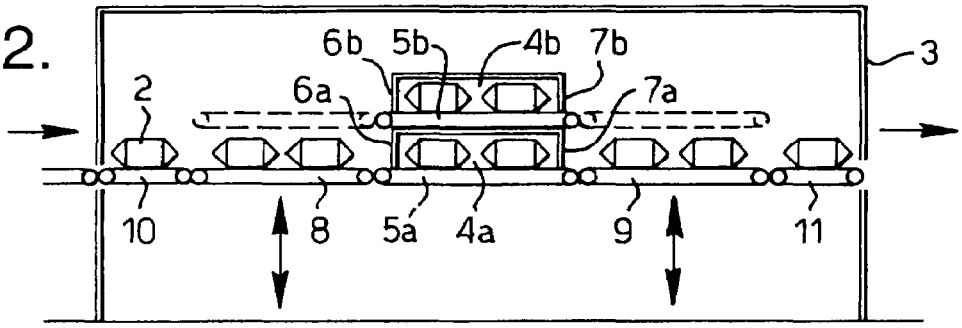
FIG. 2 is a schematic sectional side view of a first arrangement for a vacuum packaging machine according to the present invention.

In an alternative construction, the at least one in-feed and out-feed conveyors 8, 9 are fixed in the position shown in bold in FIG. 2 and the vacuum chambers 4 are movable together vertically between upper position, as shown in FIG. 2, for loading and unloading the lower vacuum chamber 4*a* and a lower position in which the vacuum chamber 4*b* is aligned with in-feed and out-feed conveyors 8, 9 for loading and unloading.

All the conveyors 5, 8, 9, 10, 11 are indexed, that is they are driven to execute an indexing motion.

The vacuum chambers 4 are illustrated as accommodating two product packages 2, but they may be dimensioned to accommodate any number of product packages 2.

The vacuum packaging machine 1 is operated in a continuous cycle controlled by an electronic control unit (not shown), although manual control is an alternative possibility. Loading and unloading of the vacuum chambers 4 is performed in a cyclical sequence and the vacuum chambers are synchronously operated to perform a vacuum sealing operation on the loaded product packages 2, including vacuumisation and sealing of the product packages 2 using the sealing bar 12. In general the provision of plural vacuum chambers 4 allows the vacuum sealing operation to be performed in one vacuum chamber 4 whilst another vacuum chamber 4 is being loaded and unloaded.

Normally, the at least one in-feed conveyor 8 and out-feed conveyor 9 are synchronously moved vertically. An opposed in-feed conveyor 8 and out-feed conveyor 9 adjacent the fixed conveyors 10, 11 are operated synchronously to receive product packages 2 from the fixed input conveyor 10 and to supply sealed product packages to the fixed output conveyor 11, and are then moved adjacent one of the vacuum chambers 4. Similarly, an opposed in-feed conveyor 8 and out-feed conveyor 9 adjacent a given vacuum chamber 4 are operated synchronously to load the given vacuum chamber 4 with unsealed product packages 2 and simultaneously to unload the same vacuum chamber 4 with the sealed product packages 2.

The advantage of providing plural in-feed and out-feed conveyors 8, 9 (as in the arrangements illustrated in FIGS. 4 and 5) is that a given vacuum chamber 4 may be loaded and unloaded using a first in-feed conveyor 8 and out-feed conveyor 9 simultaneously with supply to and from a second in-feed conveyor 8 and out-feed conveyor 9 from and to the fixed conveyors 10 and 11.

The precise order of operation of the elements of the vacuum packaging machine 1 in a cycle depends on the number of vacuum chambers 4, in-feed conveyors 8 and out-feed conveyors 9 arranged in the vacuum packaging machine 1. A possible cycle for the arrangement of the vacuum packaging machine 1 illustrated in FIG. 2 is as follows and is illustrative of the cycle for other arrangements.

As an arbitrary starting point within the cycle, we can take the point at which the vacuum sealing operation in the lower vacuum chamber 4*a* has just finished. At this time, the vacuum sealing operation in the upper vacuum chamber 4*b* is under-way. The lower vacuum chamber 4*a* is opened. Next, the fixed conveyors 10, 11, the in-feed and out-feed conveyors 8, 9 and the lower chamber conveyor 5*a* are simultaneously operated (i) to load lower vacuum chamber 4*a* with new unsealed product packages 2 from the in-feed conveyor 8, (ii) to unload sealed product packages from the lower vacuum chamber 4*a* onto the out-feed conveyor 9, and (iii) to supply new unsealed product packages 2 onto the in-feed conveyor 8. Exact synchronization is preferable but some degree of overlap is desirable. The lower vacuum chamber 4*a* is then closed for commencement of the vacuum sealing operation, that is vacuumization of the chamber 4*a* and sealing of the product packages 2 by sealing bar 12.

During the vacuum sealing operation in the lower vacuum chamber 4*a*, loading and unloading of the upper vacuum chamber 5 is performed. The out-feed conveyor 9 is operated briefly to clear sealed products off it. Then the in-feed and out-feed conveyors 8, 9 are raised to the upper vacuum chamber 4*b* and when the vacuum sealing operation in the upper vacuum chamber 4*b* has finished, the upper vacuum chamber 4*b* is opened. Simultaneous operation of the in-feed and out-feed conveyors 8, 9 and the upper chamber conveyor 5*b* loads and unloads the upper vacuum chamber 4*b*.

Subsequently, the upper vacuum chamber 4*b* is closed and the vacuum sealing operation in the upper vacuum chamber 4*b* is commenced. At the same time, the in-feed and out-feed conveyors 8, 9 are operated to load and unload the lower vacuum chamber 4*a*. That is to say, the in-feed and out-feed conveyors 8, 9 are lowered and then the in-feed conveyor 8 is operated simultaneously with the fixed conveyor 10 to fill the in-feed conveyor with new product packages 2 from in-feed conveyor 8 while the sealed packages move onto the out-feed conveyor 9.

The cycle then repeats.

Various modifications to the cycle are possible. For example, instead of simultaneously loading and unloading a vacuum chamber 4 by operating the in-feed and out-feed conveyor 8, a chamber conveyor 5 and out-feed conveyor 9 together, it is possible to operate in-feed conveyor 8 and out-feed conveyor 9 independently to perform loading and unloading separately.

Figure 3:
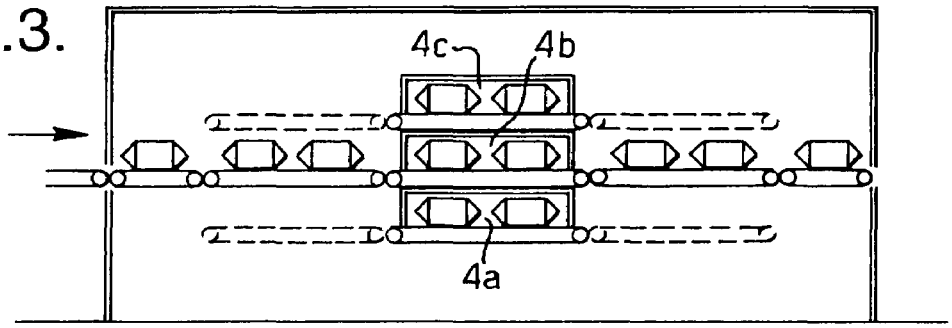
FIG. 3 is a schematic sectional side view of a second arrangement for a vacuum packaging machine according to the present invention.

In the second arrangement shown in FIG. 3 employing three vertically stacked vacuum chambers 4*a*, 4*b*, 4*c*, a possible cyclical sequence of operation is: to load and unload vacuum chamber 4*a*; to commence vacuum sealing operation in the lower vacuum chamber 4*a* and simultaneously to load and unload the middle vacuum chamber 4*b*; to commence the vacuum sealing operation in the middle vacuum chamber 4*b* and simultaneously to load and unload the vacuum chamber 4*c*; to commence the vacuum sealing operation in the upper vacuum chamber 4*c* and simultaneously to load and unload the lower vacuum chamber 4*a* once its own vacuum sealing operation has finished.

Figure 4:
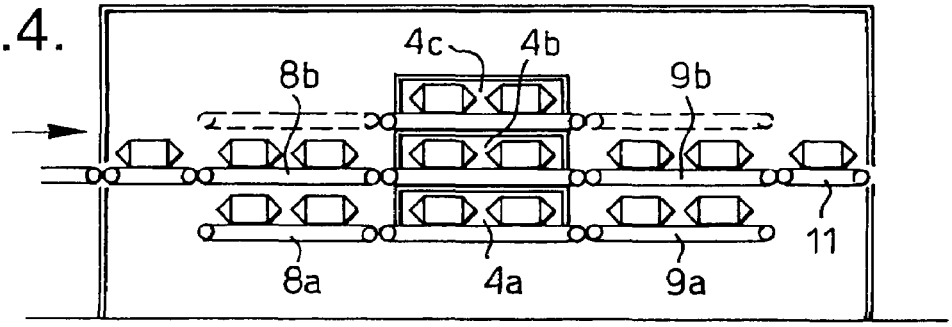
FIG. 4 is a schematic sectional side view of a third arrangement for a vacuum packaging machine according to the present invention.

In the third arrangement shown in FIG. 4, by employing three vacuum chambers 4*a*, 4*b*, 4*c* with a pair of in-feed conveyors 8*a*, 8*b* and a pair of out-feed conveyors 9*a*, 9*b* it is possible to simultaneously (i) operate one in-feed conveyor and out-feed conveyor (ii) load and unload product packages 2 from one vacuum chamber 4 and (iii) operate the other in-feed conveyor to fill it with new unsealed product packages 2 and the other out-feed conveyor to empty it of sealed product packages 2. This saves time in the operation cycle as compared to arrangements having a single in-feed conveyor 8 and a single out-feed conveyor 9.

Figure 5:
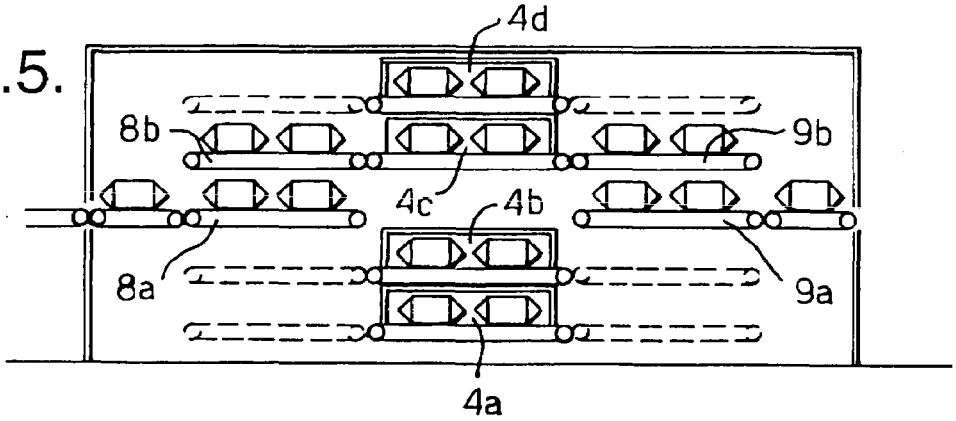
FIG. 5 is a schematic sectional side view of a fourth arrangement for a vacuum packaging machine according to the present invention.

The fourth arrangement illustrated in FIG. 5 has two separated pairs of vacuum chambers 4*a*, 4*b* and 4*c*, 4*d* and a pair of in-feed conveyors 8*a*, 8*b* and a pair of out-feed conveyors 9*a*, 9*b* having a relative vertical spacing equal to the vertical spacing between the vacuum chambers of each pair 4*a*, 4*b* and 4*c*, 4*d*.

In each arrangement, at least some of the vacuum chambers 4 have a regular spacing and the in-feed and out-feed conveyors 8, 9 have a relative spacing equal to the spacing between the vacuum chambers 4, this allowing loading and unloading of respective vacuum chambers 4 simultaneously.

Any arrangement of the vacuum packaging machine 1 with a different number of vacuum chambers may be selected to suit the particular packaging line 13 in which it is employed. Preferably the number of vacuum chambers is sufficient relative to the length of the vacuum sealing operation to allow the machine to handle the maximum rate of product package through-put on the packaging line. Therefore the preferred number and configuration of vacuum chambers depends both on the speed of the line and on the size of the vacuum chambers which is governed by the size of the product packaging.

The spacing between the vacuum chambers need not be vertical. They may instead be horizontally spaced or in a 2 dimensional array.

Figure 6:
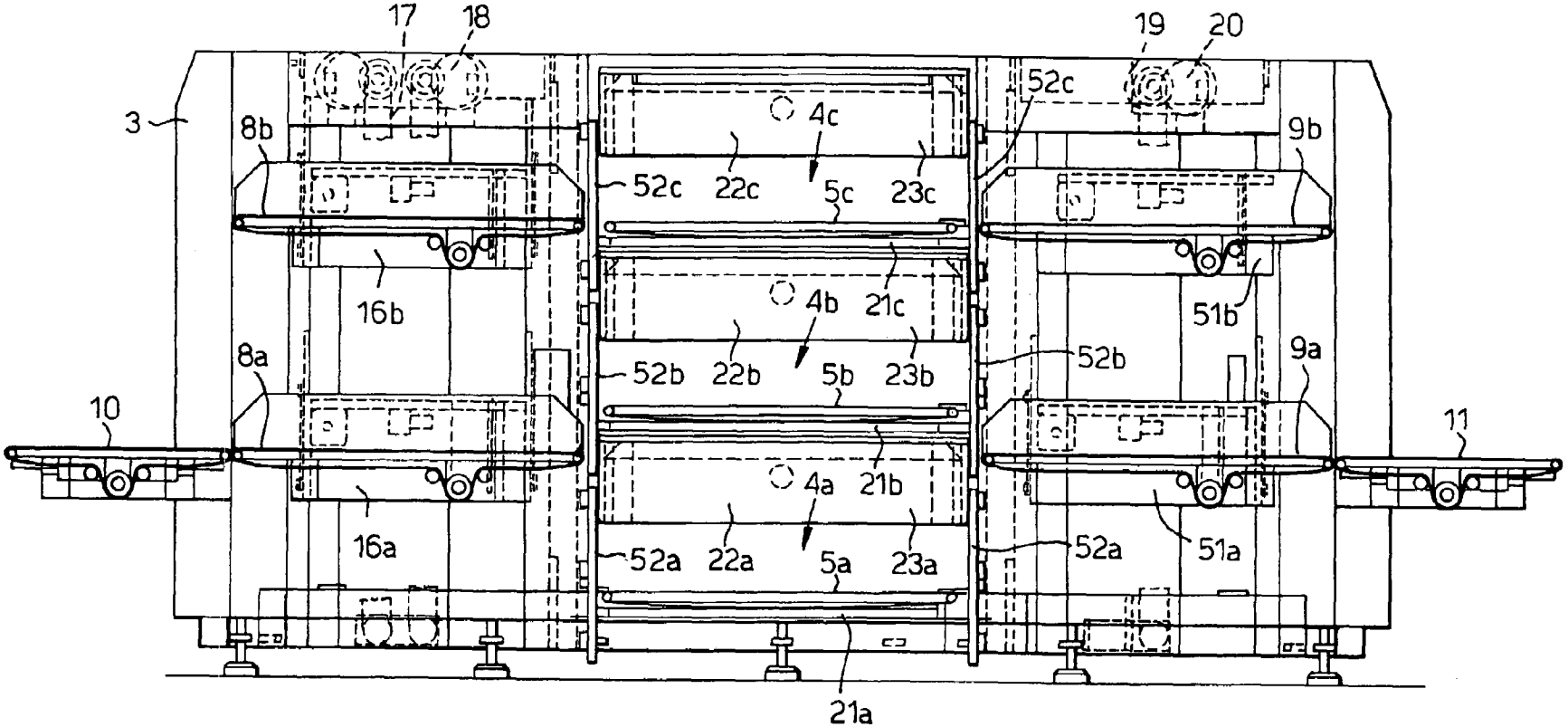
FIG. 6 is a detailed side view of a vacuum packaging machine according to the present invention.

FIG. 6 illustrates the detailed structure of the vacuum packaging machine 1 illustrated schematically in FIGS. 2 to 5, in particular with the arrangement shown in FIG. 4 of three vacuum chambers 4, two in-feed conveyors 8 and two out-feed conveyors 9.

The in-feed conveyors 8*a*, 8*b* are mounted on respective supports 16*a*, 16*b* which are together shuttled vertically by linkage to an endless belt arrangement 17 driven by a motor 18. Similarly the out-feed conveyors 9*a*, 9*b* are also mounted on respective supports 51*a*, 51*b* and shuttled vertically together by linkage to an endless belt arrangement 19 driven by a motor 20.

The vacuum chambers 4*a*, 4*b*, and 4*c* each comprise a base 21*a*, 21*b*, and 21*c* respectively, which supports the internal chamber conveyor 5*a*, 5*b*, and 5*c* respectively, and a cover 22*a*, 22*b*, and 22*c* respectively having circumferential hanging walls 23*a*, 23*b*, and 23*c* respectively, which in use form the side walls of the closed vacuum chambers 4*a*, 4*b*, and 4*c* respectively. Various elements (not shown) are attached to the covers 22*a*, 22*b*, and 22*c* including vacuum pipes, electrical tables and pneumatic pipes. The covers 22*a*, 22*b*, and 22*c* are fixed to the body 3, whereas base 21*a*, 21*b*, and 21*c* are arranged to reciprocate vertically to open and close vacuum chambers 4*a*, 4*b*, and 4*c* respectively. This means it is unnecessary to move the elements attached to covers 22*a*, 22*b*, and 22*c* which enables a simpler design and also speeds up opening and closing. When closed, base 21*a*, 21*b*, and 21*c* seals against the hanging walls 23*a*, 23*b*, and 23*c* respectively of covers 22*a*, 22*b*, and 22*c* respectively to maintain the vacuum during vacuumization. Respective pairs of guide frames 52*a*, 52*b*, and 52*c* are fixed to the body 3 to guide the vertical movement of base 21*a*, 21*b*, and 21*c* respectively.

As an alternative, it would be possible to open and close the vacuum chamber 4 by providing doors which may be hinged or which may slide perpendicularly to the movement of the product packages 2, for example on opposed trails. However, it is preferable to open and close the vacuum chamber 4 by forming it from at least two parts which are relatively movable vertically, because this allows a simpler machine design, lowers manufacturing costs and simplifies servicing and maintenance operations. This is particularly the case if one part is fixed, such as the cover 22, to which elements such as the vacuum pipes may be fixed, so that the movable part, such as the base 21, has only mechanical elements which are easily moved.

Figure 7:
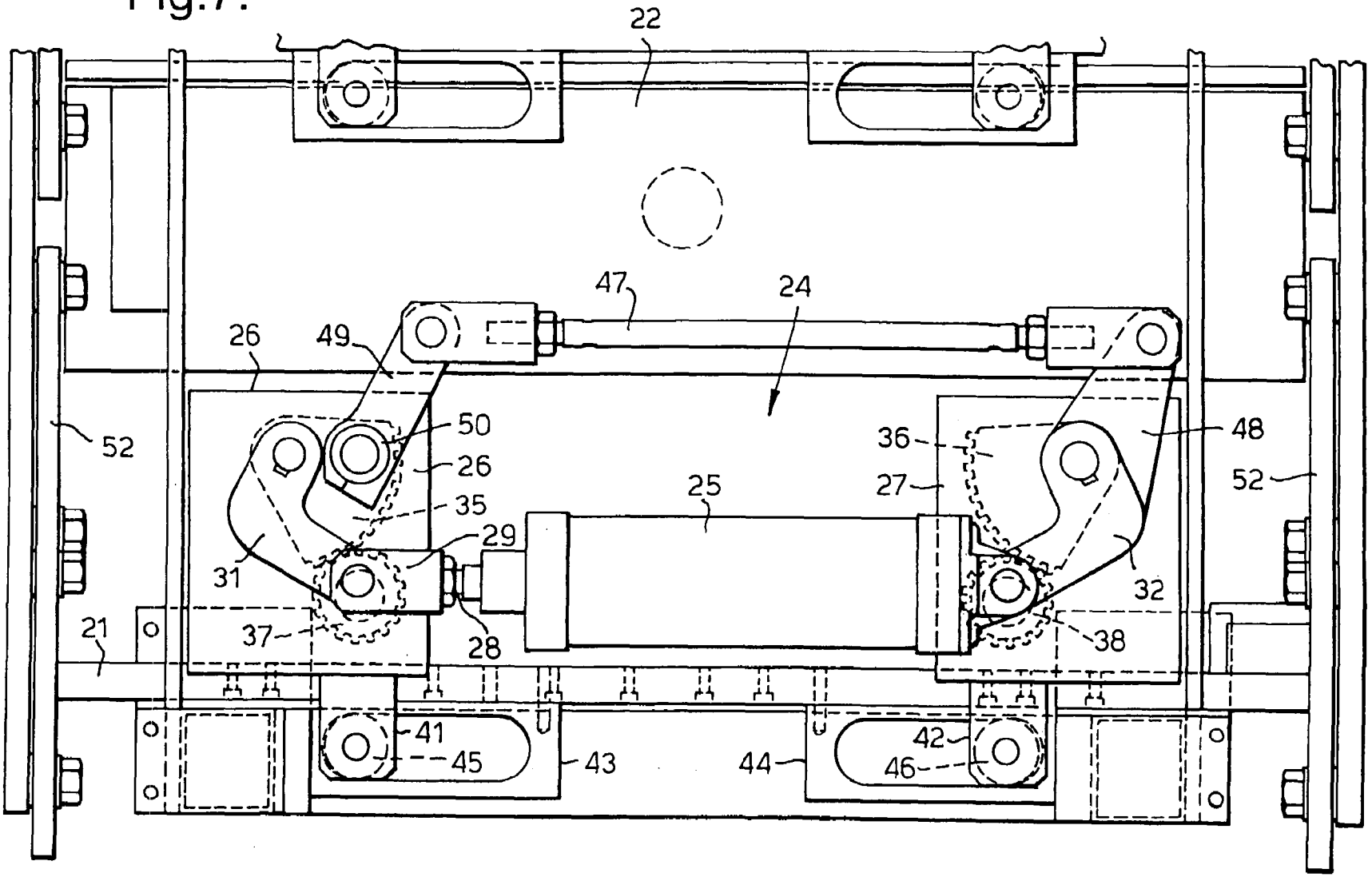
FIG. 7 is a partial enlarged view of the vacuum packaging machine shown in FIG. 6 and showing a vacuum chamber and a drive mechanism for opening and closing a vacuum chamber in an overlapping view.

Respective identical drive mechanisms 24 are provided for moving the base 21 of each vacuum chamber 4 to open and close the vacuum chamber 4. The drive mechanisms 24 are provided on the rear side of the body 3. The drive mechanisms 24 for one of the vacuum chambers 4 is illustrated in FIG. 7 in an overlapping view with a vacuum chamber 4 to illustrate the location of the drive mechanism 24 and the linkage to the other parts of the vacuum packaging machine 1. In FIGS. 8 to 11, a drive mechanism 24 is shown in isolation for clarity.

Figure 8:
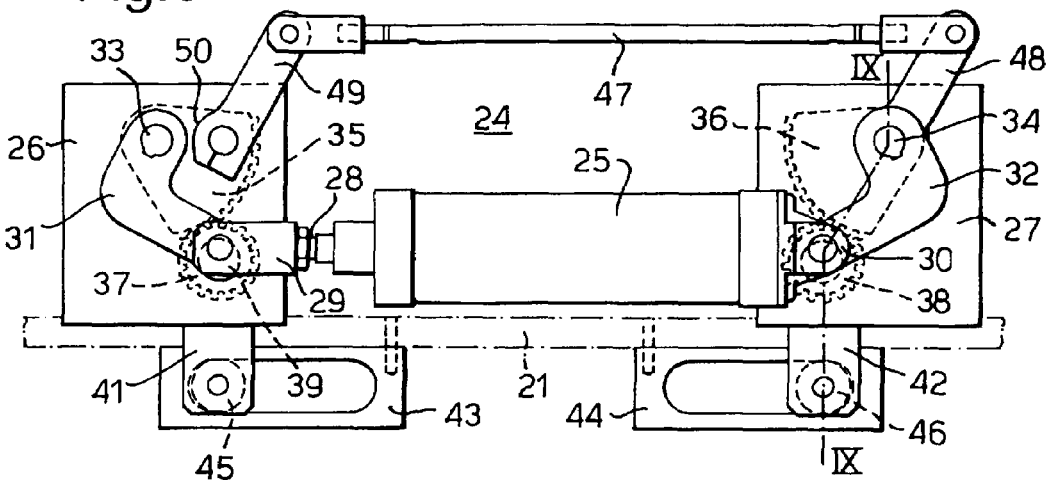
FIG. 8 is a side view of the drive mechanism of FIG. 7 in isolation in a first position.
Figure 9:
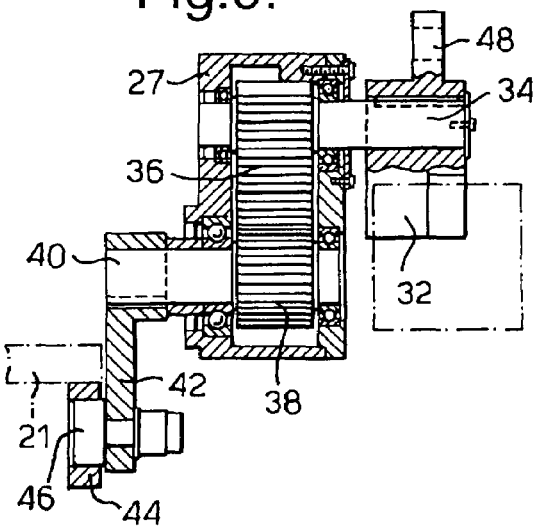
FIG. 9 is a cross-sectional view taken along line IX—IX of the drive mechanism in the first position of FIG. 7.
Figure 10:
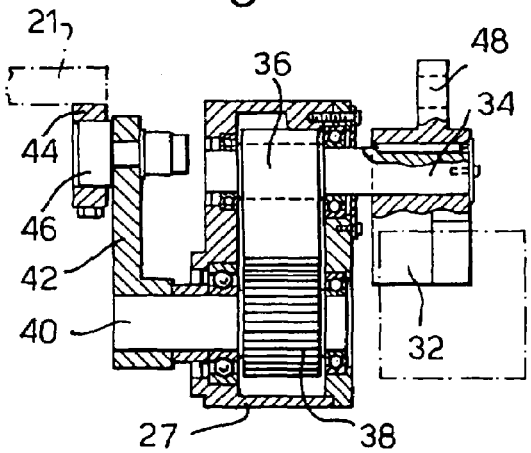
FIG. 10 is a side view of the drive mechanism in the second position.
Figure 11:
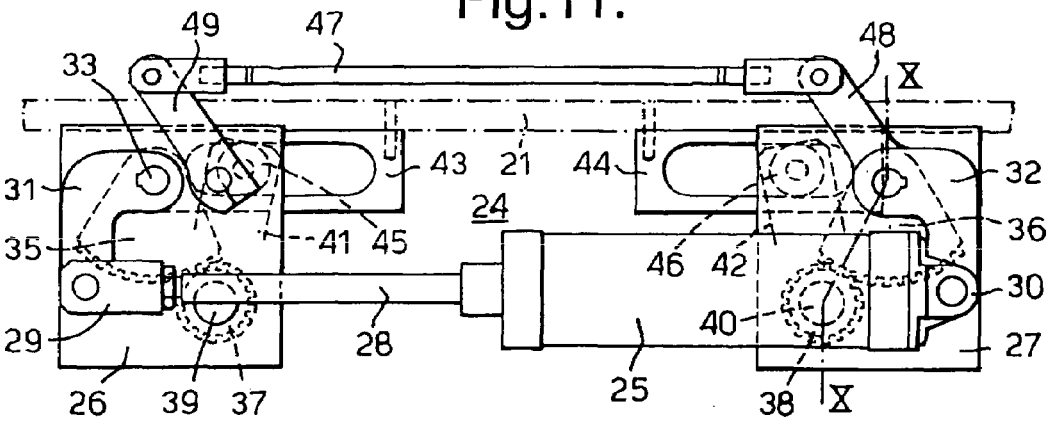
FIG. 11 is a cross-sectional view taken along line XI—XI of the drive mechanism in the second position of FIG. 10.

The drive mechanism 24 is driven by a pneumatic cylinder 25 between the position shown in FIGS. 8 and 9 where the base 21 is lowered and the position shown in FIGS. 10 and 11 where the base 21 is raised.

The drive mechanism 24 is supported on a first and second mounting blocks 26, 27 fixed to the body 3 of the vacuum packaging machine 1. The pneumatic cylinder 25 reciprocally drives a rod 28 in and out of the pneumatic cylinder 25. A cap 29 on the end of the rod 28 and the end 30 of the pneumatic cylinder 25 opposite to the rod 28 are both pivotally connected to respective angular levers 31, 32. The angular levers 31, 32 are themselves fixed on an axle 33, 34 rotatably mounted by a bearing to a respective mounting block 26, 27. A respective sector 35, 36 is fixed to each axle 33, 34 so as to rotate with the respective angular lever 31, 32. The sectors 35, 36 engage and drive respective cogs 37, 38 rotatable mounted on a bearing within the respective mounting blocks 26, 27. The cogs 37, 38 are fixed on respective drive axles 39, 40 which protrude from the mounting blocks 26, 27 and mount a respective support lever 41, 42.

Respective tracks 43, 44 are supported by studs 45, 46 fixed by a screw to the end of the respective support levers 41, 42 and positioned to slide along the tracks 43, 44. The tracks 43, 44 are fixed to the underside of the base 21 of the vacuum chamber 4 and together support the base 21.

The operation of the drive mechanism 24 is as follows.

When the base 21 is in its lowered position as illustrated in FIGS. 8 and 9, actuation of the pneumatic cylinder 25 causes the pneumatic cylinder 25 and rod 28 to be driven apart. This forces the angular levers 31, 32 to rotate away from each other, towards the position illustrated in FIG. 10. This movement of the angular levers 31, 32 drives the sectors 35, 36 away from each other which in turns drives the drive cogs 37, 38 to rotate in opposite directions. Thus the support levers 41, 42 connected to the cogs 37, 38 by the support axles 39, 40 are rotated in opposite directions towards one another. This causes the studs 45, 46 to move in an arc towards one another and thereby to reciprocate within the tracks 45, 46 and to raise the tracks 43, 44 which raises the base 21 to the position illustrated in FIGS. 10 and 11.

Similarly, actuation of the pneumatic cylinder 25 to retract the rod 28 drives motion of the drive mechanism 24 in the opposite direction to lower the base 21.

In addition, the mounting blocks 26, 27 are provided with respective rotatably mounted arms 48, 49 thereon. The arm 49 of the first mounting block 26 has a reverse gear 50 which engages the axle 33 of the first mounting block 26. The arm 48 of the second mounting block 27 is fixed to and rotates with the angular lever 32 supported by the first mounted block 27. Thus the second arm 49 is rotated in the opposite direction to the axle 33, that is in the same direction as the first arm 48. The arms 48, 49 are linked together by a rod 47 which acts as a linkage to synchronise rotation of the elements of the drive mechanism 24 mounted to the first and second mounting blocks 26, 27. The rod 47 also provides structural rigidity between the mounting blocks 25, 26 to avoid mechanical distortion of the guiding frames 52 provided at the sides of the vacuum chamber 4.

The invention claimed is:

1. A vacuum packaging machine for performing a vacuum sealing operation on product packages, comprising:

a) a permanently vertical stack of vacuum chambers each arranged to receive at least one unsealed product package and operable to perform an independent vacuum sealing operation on the at least one product package, the permanently vertical stack of vacuum chambers occupying the same size floor space as a single vacuum chamber of said stack;

at least one in-feed conveyor operable to load a selected vacuum chamber with the at least one product package, the at least one in-feed conveyor being vertically movable to select the vacuum chamber to be loaded; and c) at least one out-feed conveyor operable to unload a selected vacuum chamber with the at least one product package, the at least one out-feed conveyor being vertically movable to select the vacuum chamber to be unloaded.

2. The vacuum packaging machine of claim 1 comprising a plurality of in-feed conveyors which are vertically movable together to select the vacuum chamber to be loaded.

3. The vacuum packaging machine of claim 2 wherein the permanently vertical stack of vacuum chambers have a regular spacing between the vacuum chambers, and the plurality of in-feed conveyors have a relative spacing equal to the spacing between the vacuum chambers.

4. The vacuum packaging machine of claim 1 comprising an internal conveyor in each vacuum chamber extending from the at least one in-feed conveyor.

5. The vacuum packaging machine of claim 1 comprising a plurality of out-feed conveyors which are vertically movable together to select the vacuum chamber to be unloaded.

6. The vacuum packaging machine of claim 5 wherein the permanently vertical stack of vacuum chambers have a regular spacing between the vacuum chambers, and the plurality of out-feed conveyors have a relative spacing equal to the spacing between the vacuum chambers.

7. The vacuum packaging machine of claim 1 wherein the permanently vertical stack of vacuum chambers are vertically fixed in position.

8. The vacuum packaging machine of claim 1 wherein the at least one in-feed conveyor and the at least one out-feed conveyor are synchronously vertically movable.

9. The vacuum packaging machine of claim 1 wherein the at least one in-feed conveyor and the at least one out-feed conveyor are independently vertically movable.

10. The vacuum packaging machine of claim 1 comprising a fixed input conveyor and a fixed output conveyor.

11. A vacuum packaging machine for performing a vacuum sealing operation product packages, comprising:

a) a permanently vertical stack of vacuum chambers each arranged to receive at least one unsealed product package and operable to perform an independent vacuum sealing operation on the at least one product package, the permanently vertical stack of vacuum chambers occupying the same size floor space as a single vacuum chamber of said stack, and the permanently vertical stack of vacuum chambers being movable together vertically between an upper position and a lower position;

b) at least one in-feed conveyor operable to load a selected vacuum chamber with the at least one product package; and c) at least one out-feed conveyor operable to unload a selected vacuum chamber with the at least one product package.

12. A vacuum packaging machine according to claim 11, comprising a plurality of in-feed conveyors which are operable to load a selected vacuum chamber with the at least one product package.

13. The vacuum packaging machine of claim 12 wherein the permanently vertical stack of vacuum chambers have a regular spacing between the vacuum chambers, and the plurality of in-feed conveyors have a relative spacing equal to the spacing between the vacuum chambers.

14. A vacuum packaging machine according to claim 11 comprising an internal conveyor in each vacuum chamber extending from the at leas one in-feed conveyor.

15. A vacuum packaging machine according to claim 11, comprising a plurality of out-feed conveyors which are operable to unload a selected vacuum chamber with the at least one product package.

16. The vacuum packaging machine of claim 15 wherein the permanently vertical stack of vacuum chambers have a regular spacing between the vacuum chambers, and the plurality of out-feed conveyors have a relative spacing equal to the spacing between the vacuum chambers.

17. The vacuum packaging machine of claim 11 wherein the at least one in-feed conveyor and the at least one out-feed conveyor are vertically fixed in position.

18. The vacuum packaging machine of claim 11 wherein the permanently vertical stack of vacuum chambers are vertically movable together relative to the at least one in-feed conveyor to select the vacuum chamber to be loaded.

19. The vacuum packaging machine of claim 11 wherein the permanently vertical stack of vacuum chambers are vertically movable together relative to the at least one out-feed conveyor to select the vacuum chamber to be unloaded.

* * * * *

UNITED STATES PATENT AND TRADEMARK OFFICE

CERTIFICATE OF CORRECTION

PATENT NO. : 7,055,297 B1
APPLICATION NO. : 09/830245
DATED : June 6, 2006
INVENTOR(S) : Evangelisti et al.

It is certified that error appears in the above-identified patent and that said Letters Patent is hereby corrected as shown below:

Column 8, Line 58,"at least one in-feed" should be -- b) at least one in-feed--

Column 9, Line 32,"operation product packages" should be --operation on product packages--

Column 10, Line 18,"the at leas one in-feed" should be --the at least one in-feed--

Signed and Sealed this

Second Day of January, 2007

JON W. DUDAS
*Director of the United States Patent and Trademark Office*